United States Patent [19]

Okabe

[11] 4,104,967

[45] Aug. 8, 1978

[54] LINE PRINTER

[75] Inventor: Katsuhiko Okabe, Tokorozawa, Japan

[73] Assignee: Copal Company Limited, Tokyo, Japan

[21] Appl. No.: 849,112

[22] Filed: Nov. 4, 1977

Related U.S. Application Data

[63] Continuation of Ser. No. 643,617, Dec. 22, 1975, abandoned.

[30] Foreign Application Priority Data

| | | | |
|---|---|---|---|
| Dec. 27, 1974 | [JP] | Japan | 50-148651 |
| Dec. 27, 1974 | [JP] | Japan | 50-148652 |
| Dec. 27, 1974 | [JP] | Japan | 50-148653 |
| Dec. 27, 1974 | [JP] | Japan | 50-148654 |
| Dec. 27, 1974 | [JP] | Japan | 50-148655 |
| Apr. 23, 1975 | [JP] | Japan | 50-48637 |

[51] Int. Cl.[2] ..... B41J 1/44

[52] U.S. Cl. ..... 101/99; 101/93.22; 101/110; 101/95; 101/93.44; 101/103

[58] Field of Search ..... 101/93.22, 93.24, 93.34, 101/93.41, 93.42, 95, 97, 99, 101, 103, 106, 108, 110, 245, 359–362

[56] References Cited

U.S. PATENT DOCUMENTS

| | | | |
|---|---|---|---|
| 3,422,754 | 1/1969 | Bakardjier | 101/99 X |
| 3,690,249 | 9/1972 | Nihira | 101/95 |
| 3,734,012 | 5/1973 | Huggins | 101/103 X |
| 3,785,288 | 1/1974 | Hunter | 101/103 |
| 3,807,301 | 4/1974 | Decker | 101/110 |
| 3,838,638 | 10/1974 | Clary | 101/93.34 X |
| 3,875,859 | 4/1975 | Busch | 101/99 |
| 3,916,787 | 11/1975 | Raggensack | 101/93.41 |

*Primary Examiner*—Edward M. Coven
*Attorney, Agent, or Firm*—Haseltine, Lake & Waters

[57] ABSTRACT

Line printer having a plurality of rotatable printing rings coaxially arranged adjacent each other and carrying on the peripheries thereof a plurality of characters for the printing and a movable roller pad adapted to abut against the printing rings at the predetermined printing position so that the selected characters of the printing rings held at the printing position are simultaneously printed on a paper held between the printing rings and the roller pad so as to form simultaneously a line of printing thereon in each printing cycle. The printing rings are rotated in the same direction in each printing cycle in order to eliminate a complicated mechanism for reciprocally driving the printing rings. The selection of the characters, temporary arresting of the same at the printing position and the printing operation by the roller pad are effected during a first half cycle of each printing cycle while the paper feeding and the releasing of the characters from the printing position are effected during the last half cycle of each printing cycle by way of a single common driving shaft.

9 Claims, 20 Drawing Figures

LINE PRINTER

CROSS RELATED APPLICATION

This application is a continuation of Ser. No. 643,617 filed Dec. 22, 1975 now abandoned.

BACKGROUND OF THE INVENTION

The present invention relates to a line printer and, more particularly, to a line printer having a plurality of independently rotatable printing rings for simultaneously printing a line of printing on a paper by the selected one of characters on each of the printing rings by temporarily arresting the printing rings for positioning the selected characters at the printing position at which the roller pad is abutted against the printing rings for the printing on the paper held therebetween.

Heretofore, various line printers of the type described above have been developed. However, the prior art line printers in general utilize printing rings reciprocally rotated in each printing cycle thereby making it necessary to convert unidirectional continuous rotation of the driving motor of the printer into reciprocal rotation of each the printing rings by using mechanical means such as cams and sector gears and the like thus making the mechanism to be complicated while rendering the function to be unreasonable.

In the prior art line printer having reciprocally rotating printing rings, it is difficult to uniformly apply ink to all the characters in each printing ring by using an ink roller, because the rotational angle of the respective printing ring is different from the time at which the printing rings commence rotation for the selection of characters to the time at which the printing rings are temporarily arrested to position selected character in each printing ring at the printing position so that the rotational angle of each printing ring for returning the same to the initial angular position with respect to the driving shaft therefor after released from the arrested position is different.

Further, in the prior art line printers, the printing operation, the paper feeding and the driving of the printing rings have been in effect carried out by using a single common driving shaft in timed relation to each other. However, the releasing of the select levers for temporarily arresting the printing rings for positioning selected characters at the printing position has been effected by using another mechanism so that the timing relation of the printer might be deteriorated.

Although some prior art line printers have been proposed in which the printing rings are rotated in one and the same direction in each printing cycle, they utilize printed circuit boards corresponding to the respective printing rings and having contacts corresponding to the respective characters in the respective printing rings so that printing signals are obtained for the printing of desired characters by means of contact brushes supported by the respective printing rings which cooperate with the contacts of the printed circuit boards. Therefore, it is necessary to synchronize the printing signals from the respective printing rings with the character selecting pulses from the control circuit of the printer independently from each other, thereby making the construction complicated while large space is required for incorporating such mechanism.

The present invention aims at avoiding the above described disadvantages of the prior art line printers.

SUMMARY OF THE INVENTION

An object of the present invention is to provide a novel and useful line printer having a plurality of rotatable printing rings adapted to print a line of printing on a paper simultaneously, which avoids the disadvantages of the prior art line printers and in which the printing rings are rotated in one and the same direction in each cycle for simplification of the mechanism and the selection of desired characters on the printing rings and the arresting thereof at the printing position are effected within the first half cycle of each printing cycle, while the paper feeding and the returning of the printing rings to their initial positions with respect to the driving shaft are effected within the last half cycle thereby insuring accurate timing relation between the operations of various elements in the printer.

Another object is to provide a novel and useful line printer of the type described above which is compact in size and simple in construction and has an ink roller adapted to be pressed against the printing rings during the rotation thereof so that all the characters on the respective printing rings can be supplied with ink uniformly without fail.

A further object is to provide a novel and useful line printer in which a single common shaft is utilized for carrying out the printing operation, the paper feeding as well as the releasing of the select levers so that accurate operational timing of the printer is insured.

Other object is to provide a novel and useful line printer of the type described above and having an ink roller for supplying ink to the printing rings in which the movement of the ink roller toward and away from the printing rings for supplying ink thereto is effected by using the above described single common shaft so that the accurate operational timing is insured, while the printer is made compact as a whole and the manufacturing cost is lowered.

DETAILED DESCRIPTION OF THE PREFERRED EMBODIMENTS

Figure 1:
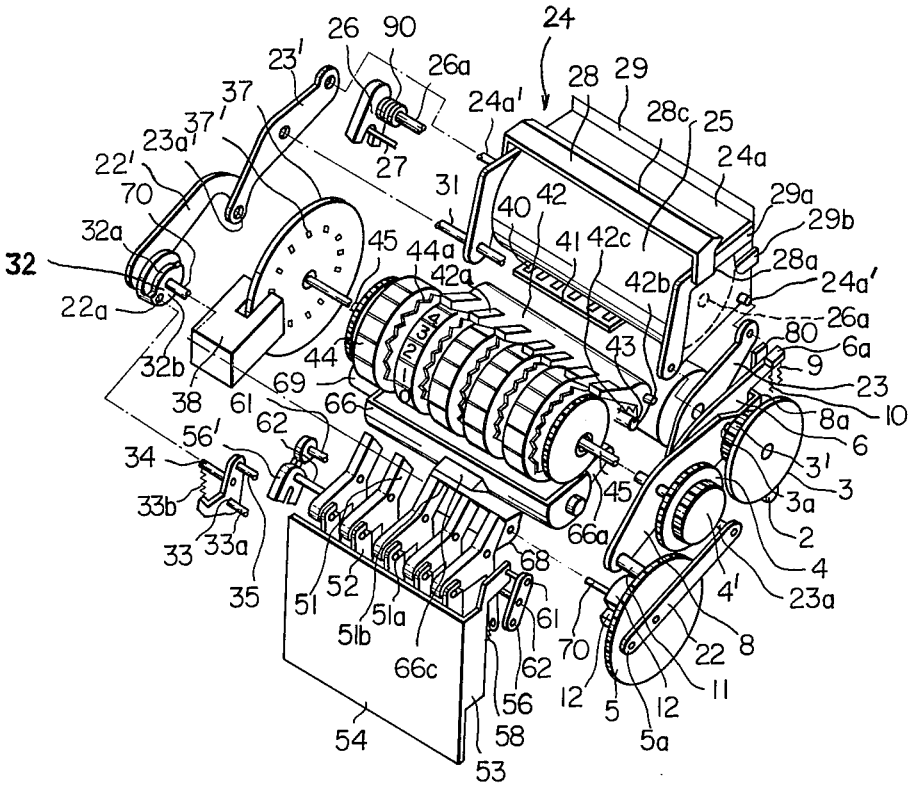
FIG. 1 is an exploded perspective view showing the general construction of an embodiment of the line printer constructed in accordance with the present invention.

FIG. 1 shows an embodiment of the line printer of the present invention.

The general correlated operations of the various elements of the printer will be described with reference to the drawings, particularly to FIG. 1.

Figure 6:
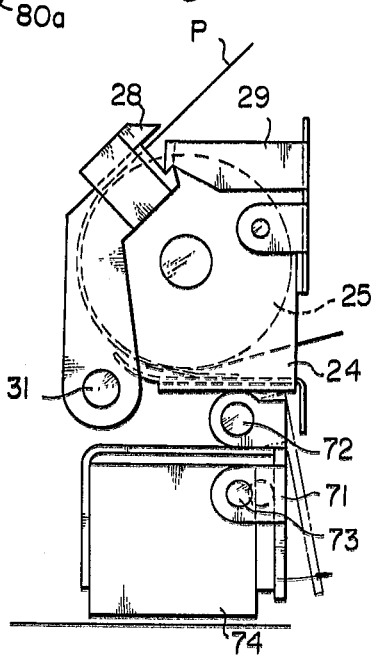
FIG. 6 is a side view showing the printing and paper feeding mechanism and the clutch magnet incorporated in the printer shown in FIG. 1.
Figure 7:
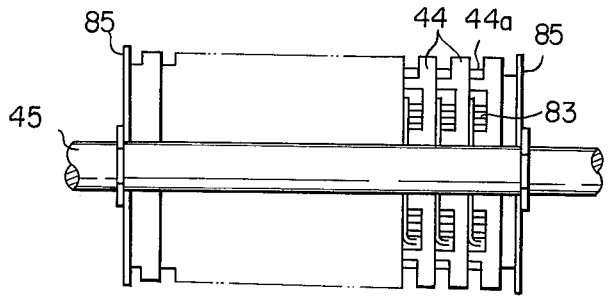
FIG. 7 is a longitudinal sectional view showing the arrangement of the printing rings shown in FIG. 1.

Upon issuance of printing demand through a control circuit of the printer well known in the art, a driving motor 1 (FIG. 9) is driven so that a motor pulley 2 is rotated thereby. At the same time, a clutch magnet 74 (FIG. 6) is energized by the printing demand so that an armature 71 is attracted by the magnet 74 thereby moving a pin 73 integral with the armature 71. Thus, a lever 80 (FIG. 2) pivoted by a shaft 80*a* secured to the printer frame and having an elongated hole 80*b* slidably receiving the pin 73 therein is swung so that a clutch lever 6 (FIG. 3) which has been arrested by the lever 80 is released (FIG. 4) thereby moving the clutch lever 6 and another clutch lever 8 having a bent portion 8*a* engaging with the lever 6 and urged thereagainst by a spring 10 tensioned between a bent portion 6*a* of the lever 6 and a bent portion 8*b* of the lever 8 in the clockwise direction by the action of a spring 9 tensioned between the bent portion 6*a* and the shaft 80*a*.

By the clockwise movement of the lever 8, a reduction wheel 3 such as a rubber wheel rotatably supported by a shaft 3*a* integral with the lever 8 contacts with the rotating motor pulley 2 thereby rotating the reduction wheel 3. A gear 3′ integral with the wheel 3 meshes with a gear 4 secured to a printing ring driving shaft 45 rotatably supported by the printer frame. Thus, the gear 4 and the driving shaft 45 are rotated. As described later in detail, a plurality of coaxially arranged printing rings 44 rotatably supported adjacent to each other on the driving shaft 45 and each resiliently arrested at a predetermined initial starting position with respect to the shaft 45 through a spring 83 (FIG. 8) for each printing ring 44 are also rotated together with the shaft 45.

Each of the printing rings 44 bears on the periphery thereof a plurality of characters spaced from each other in the circumferential direction of the ring 44 thereby making ready for selection of desired character in each ring 44 to be arrested at a predetermined printing position for the printing operation in cooperation with a printing roller pad 25 to be described later.

Figure 5:
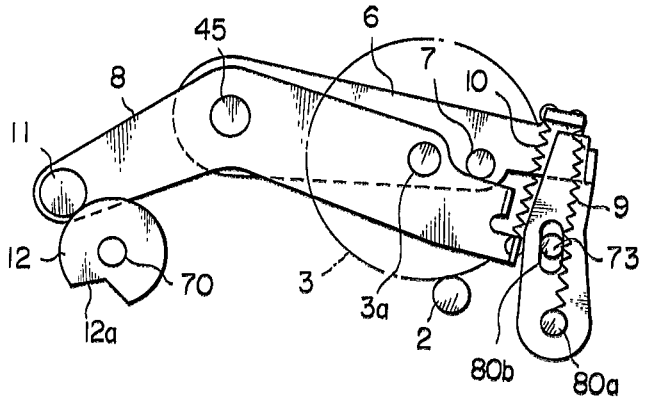

A gear 5 secured to a cam shaft 70 rotatably supported by the printer frame is driven by a gear 4′ integral with the gear 4. Thus, a cam 12 secured to the cam shaft 70 is also rotated so that the recessed portion 12*a* of the cam 12 which has been engaged with a pin 11 integral with the lever 8 (FIG. 3) is moved apart (FIG. 5) from the pin 11 and the pin 11 slidably contacts with the periphery of the cam 12 thereby permitting the reduction wheel 3 to be continuingly rotated by the motor pulley 2 even after the clutch magnet 74 is deenergized.

The speed ratio between the printing ring driving shaft 45 and the cams shaft 70 is so determined by the gears 4′ and 5 that the cam shaft 70 rotates one revolution as the driving shaft rotates two revolutions, and select levers 51 (FIG. 9) to be described later are actuated within the first revolution of the shaft 45 so as to selectively arrest the respective printing rings 44 for selection of the desired character in each ring 44 to be positioned at the printing portion and, at the end of the first revolution of the shaft 45, i.e., at the end of the first half revolution of the cam shaft 70, a printing roller pad supporting frame 24 pivoted by a shaft 31 supported by the printer frame is swung toward the printing rings 44 through the linkage means 22, 23, 22′, 23′ operably connected between an eccentric pin 5a of the gear 5, an eccentric pin 22a of a cam 32 secured to the cam shaft 70 and the frame 24 to be described later in detail so that a printing roller pad 25 rotatably supported in the frame 24 by a roller pad supporting shaft 26*a* integral with the pad 25 is abutted against the respective printing rings 44 at the printing position thereby permitting the selected characters of the rings 44 to be printed on a paper held between the rings 44 and the pad 25.

As the cam shaft 70 continues to further rotate, i.e., after the commencement of the second revolution of the driving shaft 45, the frame 24 is returned to the initial position by the actuation of the linkage means 22, 23, 22′, 23′, and, during the return movement of the frame 24, the roller pad supporting shaft 26a is rotated a predetermined amount by means of one-way clutch spring 90 (FIG. 12) to be described later so that the pad 25 is also rotated so as to feed the paper by the cooperation of a comb shaped plate spring 40 (FIGS. 13 and 14) also to be described later.

Figure 9:
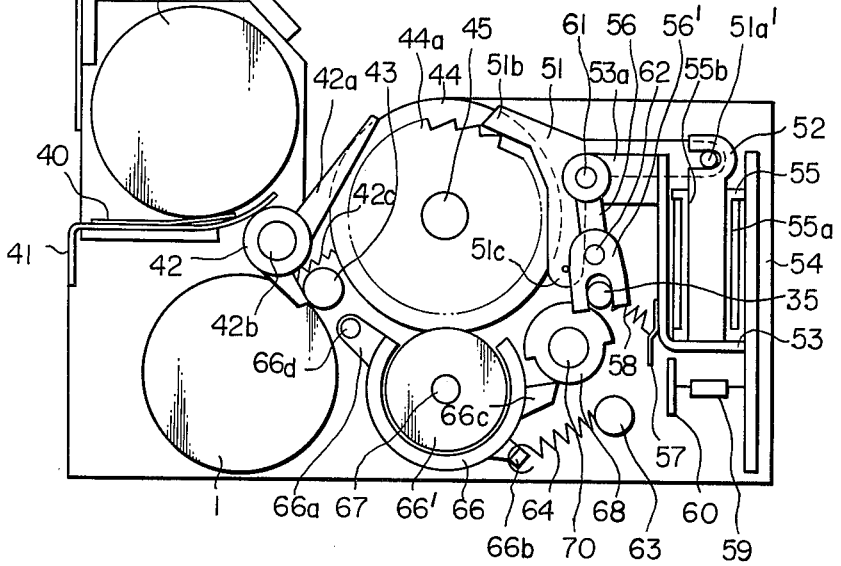
FIG. 9 is a side view showing the arrangement of the printing ring mechanism, the select levers, the select magnets and the ink roller of the printer shown in FIG. 1.

An ink roller holder body 66 (FIGS. 9, 15 – 17) is swingably supported from the printer frame beneath the printing rings 44 by a pin 66d provided on the end of an arm 66*a* integral with the body 66, and an ink roller 66′ rotatably supported in the body 66 is adapted to be urged against the respective printing rings 44 through a cut-out portion 66*e* of the body 66 by the action of a spring 64 tensioned between the latching portion 66*b* of the body 66 and a pin 63 integral with the printer body so as to supply ink to the respective printing rings 44 during the rotation thereof, but the ink roller 66′ is held apart from the printing rings 44 during the first revolution of the shaft 45 because a projection 66*c* provided on the body 66 engages with a cam 68 secured to the cam shaft 70 so that, when the projection 66*c* is engaged with the raised portion of the cam 68 during the first revolution of the shaft 45, i.e., during the first half revolution of the cam shaft 70, the body 66 is held swung in the clockwise direction as seen in FIG. 9 so as to maintain the ink roller 66' spaced apart from the printing rings 44, whereas, when the projection 66c engages with the recessed portion of the cam 68 during the last half revolution of the cam shaft 70, i.e., during the second revolution of the printing ring driving shaft 45, the body 66 is swung in the counterclockwise direction by the action of the spring 64 so that the ink roller 66' is urged against the printing rings 44 to supply ink thereto.

As described later, as the cam shaft 70 is rotating during its first half revolution, a projection 23b (FIG. 2) of the link 23 is abutted against a pin 7 formed on the clutch lever 6 so that it is urged upwardly against the action of the spring 9. At the same time, the lever 6 is arrested (FIG. 5) by the lever 80 which has been returned to the position ready for arresting the lever 6 by the deenergization of the clutch magnet 74 and, at the end of one revolution of the cam shaft 70, the recessed portion 12a of the cam 12 engages again with the pin 11 of the clutch lever 8 so that the lever 8 is attracted upwardly toward the lever 6 by the action of the spring 10 thereby disengaging the reduction wheel 3 from the motor pulley 2 to stop the rotation of the driving shaft 45 and hence the rotation of the cam shaft 70 so as to complete one printing cycle to be ready for the next printing cycle upon issuance of the printing demand from the control circuit of the printer.

The select levers 51 (FIGS. 9 and 10) for selectively arresting the respective printing rings 44 so as to position desired characters in the respective printing rings 44 at the printing position are swingably supported by a shaft 61 which is rotatably supported by a bracket 53 of a magnetic yoke 53 secured to a supporting plate 54.

Select magnets 55 corresponding in number to that of the select levers 51 are mounted on the supporting plate 54 and operatively cooperate with the select levers 51 which in turn cooperate with the respective printing rings 44 for temporarily arresting the same so as to position selected characters at the printing position. To this end, an armature 52 is slidably housed in a hollow portion 55b of each of the magnets 55 and the hooked portion each of the armatures 52 is engaged with a pin 51a secured to one arm of each of the levers 51. Each of the select levers 51 is normally urged in the counterclockwise direction by a spring 58 tensioned between downwardly extending arm 51c of the lever 51 and a stationary portion in the printer frame so that an arresting claw 51b each of the levers 51 is urged against a ratchet wheel 44a integral with the respective ring 44 as seen in FIG. 9 so as to arrest the rotation of the respective ring 44 when the claw 51b engages with any of the teeth of the ratchet wheel 44a.

The positions of the teeth of the ratchet wheel 44a correspond to the respective characters in each printing ring 44 so that, when the ring 44 is temporarily arrested by the engagement of the claw 51b with the selected tooth of the ratchet wheel 44a, desired character of the ring 44 is positioned at the printing position. However, the select magnets 55 are normally energized so as to attract the armatures 52 downwardly so that the select levers 51 are moved in the clockwise direction and held thereat by the engagement of the pins 51a with the hooked portions of the armatures 52 thereby maintaining the arresting claws 51b disengaged from the ratchet wheels 44a.

Thus, when the select magnets 55 are selectively deenergized as the desired characters of the rings 44 are brought to the printing position during the first revolution each of the rings 44 upon issuance of the printing demand, the armatures 52 are selectively released and the respective select levers 51 are moved in the counterclockwise direction by the action of the springs 58 so as to selectively and temporarily arrest the rotation of the respective rings 44 while the driving shaft 45 continues its first revolution by virtue of the respective springs 83 (FIG. 8) being further energized by the relative rotation between the shaft 45 and the respective rings 44 thereby permittinb desired character in each ring 44 to be temporarily held at the printing position.

A slit disc 37 (FIGS. 1 and 11) is secured to the driving shaft 45 in order to generate synchronizing pulses for detecting the angular position each of the characters of the printing rings 44 before they are temporarily arrested. The disc 37 is formed with circumferentially spaced slits 37' the positions of which correspond to those of the characters of the rings 44 before they are arrested, and U-shaped optical detecting device 38 is provided in the printer in straddling relation to the disc 37. The detecting device 38 has a light source and an optical detecting element for receiving the light from the light source through the slits 37' so that a synchronizing pulse is generated each time the light is received by the detecting element through the respective slit 37' during the rotation of the shaft 45 so as to detect the position of the characters of the rings 44 for selection of the desired one thereof. The synchronizing pulses are supplied to the control circuit of the printer so as to serve to select the desired character for the printing.

In order to release the temporary arresting of the printing rings 44 so as to return them to the initial starting positions with respect to the driving shaft 45 by the action of the springs 83 after the printing operation, a select release lever 56 and a select release lever 56' (FIGS. 1, 9 and 10) are secured to the shaft 61 rotatably supported by the bracket 53 and swingably supporting thereon the select levers 51, and a shaft 62 is supported at the respective ends thereof by the levers 56, 56' so that, when the levers 56, 56' are swung in the clockwise direction (FIGS. 1 and 9) about the shaft 61, the shaft 62 is urged against the sides of the downwardly extending arms 51c of the select levers 51 thereby releasing the arresting of the ratchet wheels 44a by the claws 51b against the action of the springs 58.

In order to release the claws 51b from the ratchet wheels 44a in accurate timing relation to the rotation of the driving shaft 45 as well as to the rotation of the cam shaft 70, a lever 33 (FIG. 1) is pivotally supported by a shaft 33a secured to the printer frame and urged in the clockwise direction by a spring 33b tensioned between a lower arm of the lever 33 and a stationary point in the printer frame. A pin 35 secured to the upper arm of the lever 33 slidably engages with the bifurcated portion of the select release lever 56' (FIGS. 1, 9 and 10), while a pin 34 secured to an intermediate portion of the upper arm of the lever 33 slidably engages with a recessed cam surface 32a and a raised cam surface 32b of the cam 32 secured to the cam shaft 70.

The angular positions of the cam portions 32a, 32b with respect to the cam shaft 70 are so determined that the recessed cam portion 32a contacts with the pin 34 during the first half revolution of the cam shaft 70 caused by the actuation of the clutch levers 6, 8 upon issuance of the printing demand, i.e., during the first revolution of the printing ring driving shaft 35 within which the selection of the characters and arresting of the printing rings 44 followed by the printing operation by the roller pad 25 are effected, so that the lever 33 is swung in the clockwise direction and the select release lever 56' engaging with the pin 35 is swung in the counterclockwise direction thereby moving the shaft 62 apart from the downwardly extending arms 51c of the select levers 51.

This permits the engagement of the claws 51b of the select levers 51 with the ratchet wheels 44a by the deenergization of the select magnets 55 caused by the printing demand for arresting the printing rings 44, while the pin 34 contacts with the raised cam portion 32b during the last half revolution of the cam shaft 70, i.e., during the second one revolution of the driving shaft 45 within which the paper feeding and the application of ink to the printing rings 44 are effected, so that the select levers 51 are positively released from the ratchet wheels 44a by the engagement of the shaft 62 with the lower arms 51c of the select levers 51 caused by the clockwise swinging of the select release lever 56' engaging with the pin 35 of the lever 33 which is in turn swung in the counterclockwise direction by the engagement of the pin 34 with the raised cam portion 32b of the cam 32.

Thus, the releasing of the select levers 51 are positively effected in timed relation to the rotation of the printing rings 44 and the actuation of the roller pad 25 and the paper feeding as well as to the actuation of the ink roller 66' by means of a common single cam shaft 70 mechanically coupled with the printing ring driving shaft 45.

The select magnets 55 are energized at the same time the motor 1 is energized so that the claws 51b of the select levers 51 are moved apart from the ratchet wheels 44a.

When the desired characters of the respective printing rings 44 are selected by the control circuit by the aid of the supply of the synchronizing pulses to the control circuit of the printer, the respective select magnets 55 are selectively deenergized so as to arrest the respective printing rings 44 as described earlier.

Comb-shaped lever 42a pivoted by a shaft 42b and urged by a spring 42c so as to be spaced apart from the printing rings 44 serves to prevent printing of undesired portion of the paper other than the selected characters for the printing.

Now, details of various components of the printer of the present invention will be described.

Clutch mechanism

Figure 2:
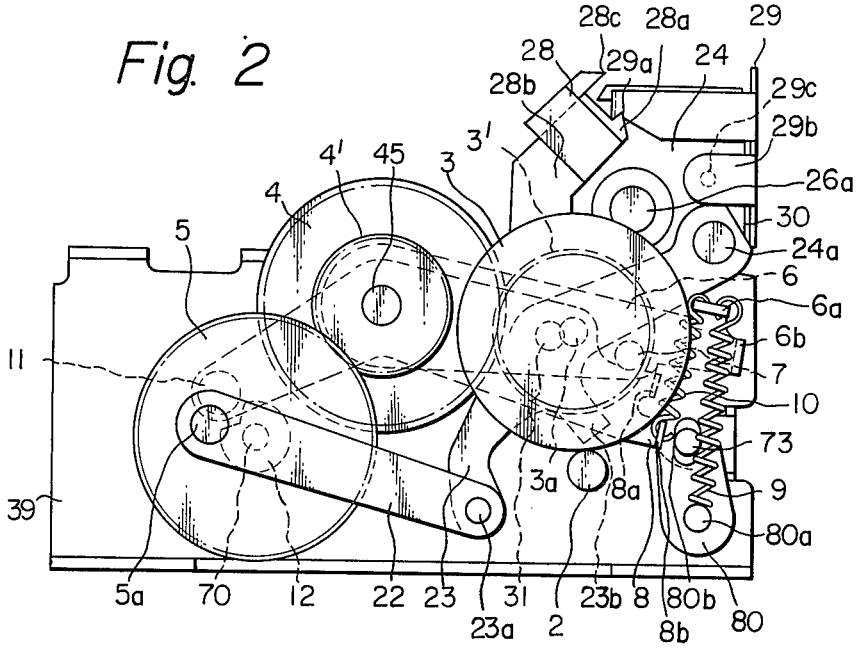
FIG. 2 is a side view showing the clutch mechanism shown in FIG. 1.
Figure 3:
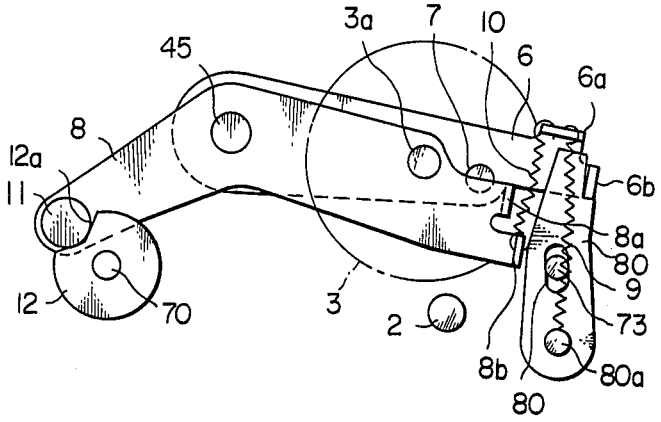
FIGS. 3 – 5 are side views showing the operation of the clutch levers of the clutch mechanism shown in FIG. 2 in various operating conditions, respectively.
Figure 4:
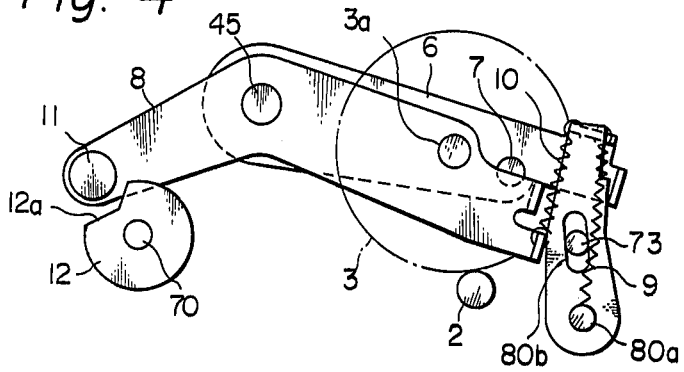

Referring to FIGS. 2 – 5, the clutch levers 6, 8 pivoted by the driving shaft 45 are urged toward each other by the spring 10 tensioned between the bent portions 6a, 8b and the bent portion 8a abuts against the lever 6 to maintain the relative positions of the levers 6, 8. The lever 6 is urged downwardly together with the lever 8 by the spring tensioned between the bent portion 6a and the shaft 80a so that the bent portion 6b is arrested by the shoulder of the lever 80 pivoted by the shaft 80a (FIG. 3). In this position, the reduction wheel 3 rotatably supported by the shaft 3a on the lever 8 is spaced apart from the motor pulley 2.

The pin 73 provided on the armature 71 of the clutch magnet 74 (FIG. 6) is slidably engaged in the elongated hole 80b of the lever 80 so that, when the clutch magnet 74 is energized upon issuance of the printing demand together with the energization of the motor 1 (FIG. 9) causing the rotation of the motor pulley 2, the armature 71 together with the pin 73 is moved leftward (FIG. 6) so that the shoulder of the lever 80 is disengaged from the bent portion 6b of the clutch lever 6 (FIG. 4) thereby moving the lever 6 downwardly by the action of the spring 9. The clutch lever 8 is also moved downwardly by the engagement of the bent portion 8a with the lever 6 so that the reduction wheel 3 abuts against the rotating motor pulley 2 thereby rotating the reduction wheel 3.

As shown in FIG. 2, the gear 3' integral with the reduction wheel 3 meshes with the gear 4 integral with the printing ring driving shaft 45 while the gear 4' integral with the gear 4 meshes with the gear 5 secured to the cam shaft 70 so that the driving shaft 45 and the cam shaft 70 are rotated by the rotation of the reduction wheel 3. Ad previously described, the cam shaft 70 is rotated by one revolution when the driving shaft 45 rotates two revolutions by the setting of the gear ratio between the gears 4' and 5.

The cam 12 having the recessed portion 12a is secured to the cam shaft 70 and the pin 11 secured to the distal end of the clutch lever 8 cooperates with the cam 12 and, at the initial positions of the clutch mechanism, the recessed portion 12a engages with the pin 11 as shown in FIG. 3 wherein the levers 6, 8 are arrested by the lever 80 in their raised positions to maintain the reduction wheel 3 spaced from the motor pulley 2. When the lever 6 is released from the lever 80 to lower the levers 6, 8 (FIG. 4) so that the reduction wheel 3 is engaged with the motor pulley 2 to commence the rotation, the cam 12 is also rotated by the rotation of the cam shaft 70 and the pin 11 rides on the raised portion of the cam 12 thereby maintaining the lever 8 in its lowered position (FIG. 5) so as to positively engage the reduction wheel 3 with the motor pulley 2 to continue the rotation of the reduction wheel 3 even after the clutch magnet 74 is deenergized.

The clutch magnet 74 is deenergized shortly after the same has been energized so that the lever 80 is returned to the position for arresting the lever 6 through the interposition of the pin 73 between the armature 71 and the lever 80. The gear 5 is provided with the eccentric pin 5a and the link 22 is pivotally connected at its one end to the eccentric pin 5a while the other end of the link 22 is pivotally connected through the pin 23a to one end of the link 23 which is pivotally supported at its intermediate portion by the shaft 31 pivotally connected to the roller pad supporting frame 24. The other end of the link 23 is pivotally connected to the pin 24a' secured to a roller pad supporting frame 24 and rotatably supported by the printer frame.

The projection 23b formed in the link 23 and extending downwardly therefrom is engageable with the pin 7 secured to the clutch lever 6 (FIG. 2). Thus, when the cam shaft 70 rotates in the clockwise direction by a half revolution, the link 23 is swung in the counterclockwise direction through the link 22 so that the pin 7 is urged upwardly (FIG. 2) by the projection 23b of the link 23 so that the clutch lever 6 is moved upwardly thereby permitting the lever 6 to be arrested by the shoulder of the lever 80 (FIG. 5) independently of the lever 8 which is urged in the clockwise direction by the pin 11 riding on the raised cam portion of the cam 12 so as to continue the rotation of the reduction wheel 3 by the motor pulley 2.

When the cam shaft 70 rotates a revolution to bring the recessed portion 12a again in the position at which it engages with the pin 11, the lever 8 is allowed to rotate in the counterclockwise direction toward the lever 6 by the action of the spring 10 so that the bent portion 8a abuts against the lever 6 (FIG. 3) thereby moving the reduction wheel 3 apart from the motor pulley 2 to stop the rotation of the reduction wheel 3 and hence the rotation of the driving shaft 45 and the cam shaft 70 so as to complete one printing cycle. The arrangement of the motor pulley 2 and the reduction wheel 3 permits greater reduction ratio to be obtained.

Printing and paper feeding mechanism

Referring to FIGS. 2, 6 and 11–14, the intermediate portion of the link 23' is pivotally supported by the shaft 31 and one end of the link 23' is pivotally connected to the pin 24a' secured to the roller pad supporting frame 24 and pivotally supported by the printer frame, while the other end of the link 23' is pivotally connected by a pin 23a' to one end of the link 22' the other end of which is pivotally connected to the eccentric pin 22a provided on the cam 32 which is secured to the cam shaft 70. The arrangement and the geometrical configuration and the movement of the eccentric pin 22a, the links 22', 23' and the pin 24a' are symmetrical or similar to those of the eccentric pin 5a, the links 22, 23 and the pin 24a'.

Thus, when the cam shaft 70 rotates the first half revolution, the pin 24a' is moved obliquely downwardly about the shaft 31 by the swinging movement of the links 23, 23', caused by the movement of the links 22, 22', so that the roller pad supporting frame 24 is swung in the counterclockwise direction as shown in FIG. 2 toward the printing rings 44, while, when the cam shaft 70 rotates the last half revolution, the frame 24 is returned to its initial position shown in FIG. 2 apart from the printing rings 44.

Figure 12:
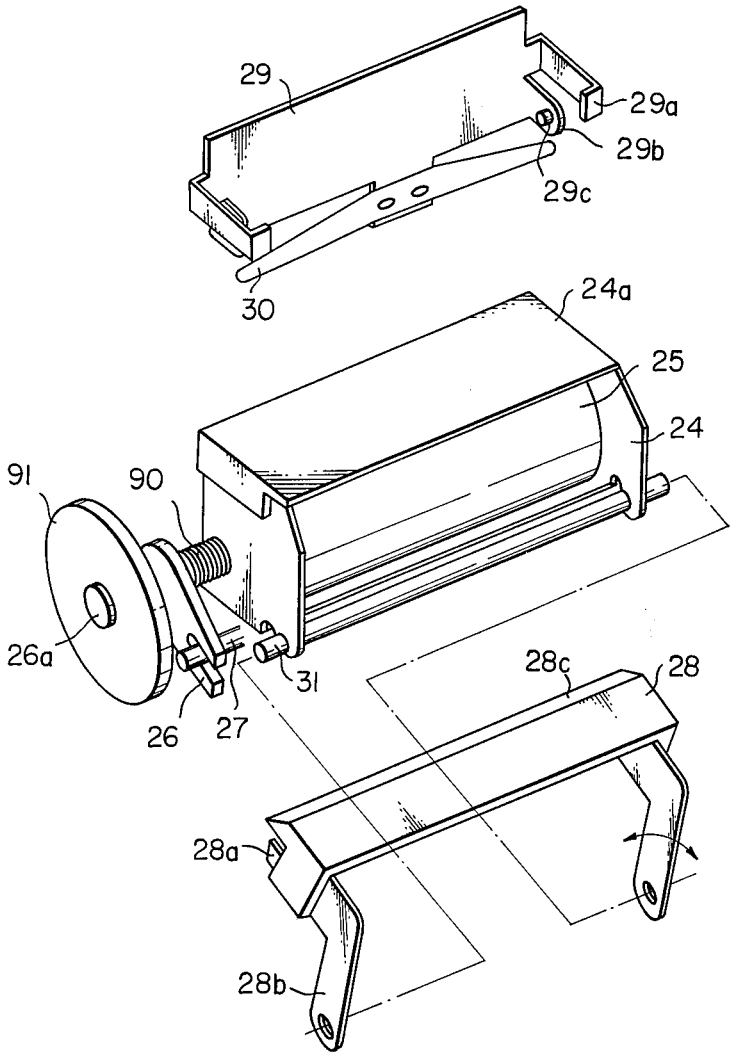
FIG. 12 is an exploded perspective view showing the rubber roller pad device for the printing incorporated in the printer of FIG. 1.

As shown in FIG. 12, the roller pad supporting frame 24 is provided with a back plate 29 attached to the frame 24 by pins 29c secured to brackets 29b formed in the back plate 29, a cover plate 24a and a cutter 28 having a cutter blade 28c and pivotally supported at leges 28b thereof by the shaft 31. The roller pad 25 secured to the shaft 26a is rotatably supported in the frame 24 by the shaft 26a and, when the cam shaft 70 rotates the first half revolution so as to move the frame 24 toward the printing rings 44, the roller pad 25 is abutted against the printing rings 44 at the printing position so that the selected characters of the respective printing rings 44 positioned at the printing position are printed on the paper sandwiched between the printing rings 44 and the roller pad 25.

Figure 13:
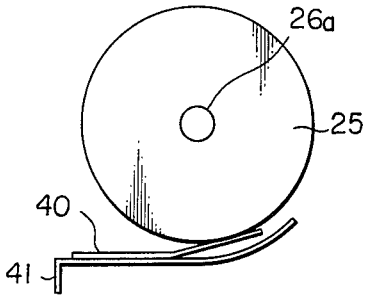
FIG. 13 is a side view showing the rubber roller pad and the plate spring for slidably clamping a paper to be printed between the roller pad and the plate spring.
Figure 14:
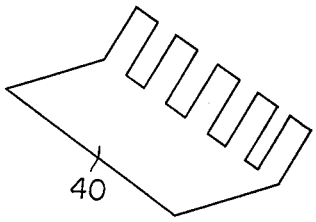
FIG. 14 is a perspective view showing the plate spring of FIG. 13.

As shown in FIGS. 13 and 14, a guide plate 41 and a comb-shaped paper pressing plate spring 40 attached to the guide plate 41 are arranged beneath the roller pad 25 and secured to the frame 24, and the paper P (FIG. 6) is pressed against the roller pad 25 with uniform pressure by the comb-shaped portions of the plate spring 40.

A manually operable paper feeding knob 91 is secured to one end of the shaft 26a so that the paper held between the roller pad 25 and the plate spring 40 can be manually fed by rotating the knob 91.

Further, a lever 26 having bifurcated portions is secured to the shaft 26a (FIG. 12) and one end of the one-way clutch spring 90 in the form of a closely wound helical spring arranged around the shaft 26a is supported by the lever 26. The arrangement of the one-way clutch spring 90 is so determined that the shaft 26a and, hence, the roller pad 25 are rotated only in the paper feeding direction by a predetermined amount each time the lever 26 is reciprocally swung, i.e., when the frame 24 is returned to its initial position. The one-way clutch spring is conventional and detailed description is omitted. The bifurcated portions of the lever 26 slidably receive a pin 27 secured to a stationary portion of the printer frame. The position of the pin 27 is so determined that the lever 26 is reciprocally swung by an angle greater than the angle of the reciprocal swinging of the roller pad supporting frame 24, so that, when the roller pad supporting frame 24 is reciprocally swung, the lever 26 is reciprocally swung relative to the frame 24 so as to automatically feed the paper by means of the one-way clutch spring 90.

Inwardly bent arresting portions 29a formed in the back plate 29 releasably engage with arresting portions 28a of the cutter 28 (FIG. 11) so as to hold the cutter 28 in its paper cutting position. The spring 30 secured to the back plate 29 serves to positively maintain the arresting portions 28a resiliently arrested by the arresting portions 29a.

Figure 11:
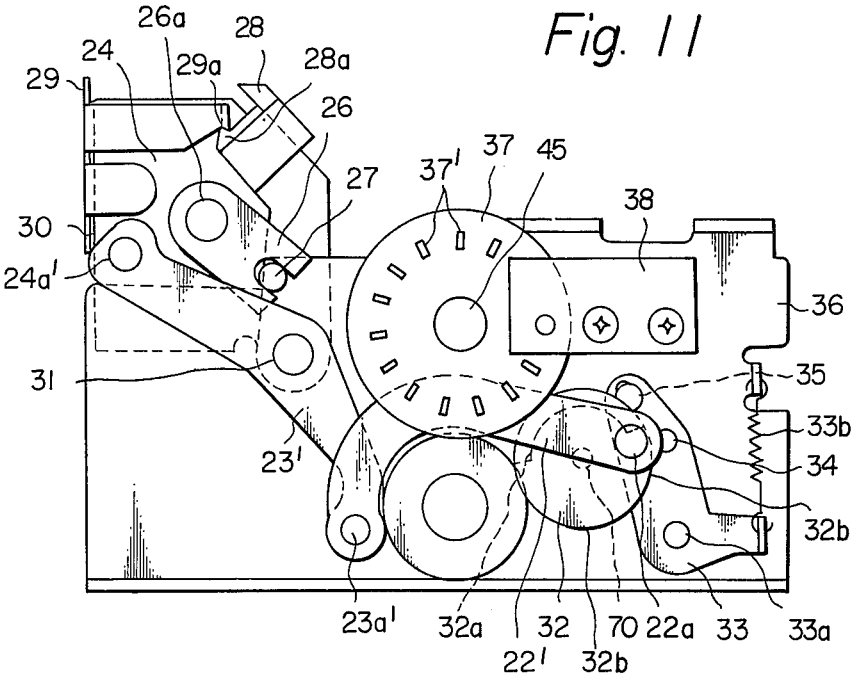
FIG. 11 is a side view showing the slit disc and the detecting device for generating synchronizing pulses corresponding to the respective characters in each printing ring during the rotation thereof prior to the arresting for selection of desired character.

As seen from FIGS. 11 and 12, since the pivoting point of the cutter 28, i.e., the shaft 31, is positioned near the side of the operator of the printer, the cutter 28 is turned toward the operator when the same is removed from its operative position arrested by the arresting portions 29a, thereby making it unnecessary to thread the paper through the cutter 28 when the paper is to be loaded on the printer so that the damage to the operator which might occur during the loading of the paper is positively avoided.

Printing ring mechanism

As shown in FIGS. 7 – 11, the printing rings 44 are rotatably supported on the driving shaft 45 adjacent to each other and each of the printing rings 44 has a ratchet wheel 44a integrally formed therewith. Each of the ratchet wheels 44a has ratchet teeth corresponding to the respective characters provided on the periphery of each printing ring 44. An annular recessed portion 44b is formed between the ratchet wheel 44a and a boss 44c of each printing ring 44 and the boss 44c is provided with an arresting cut-out portion 44d. The annular recessed portion 44b is formed with an arresting projection 44'.

Figure 8:
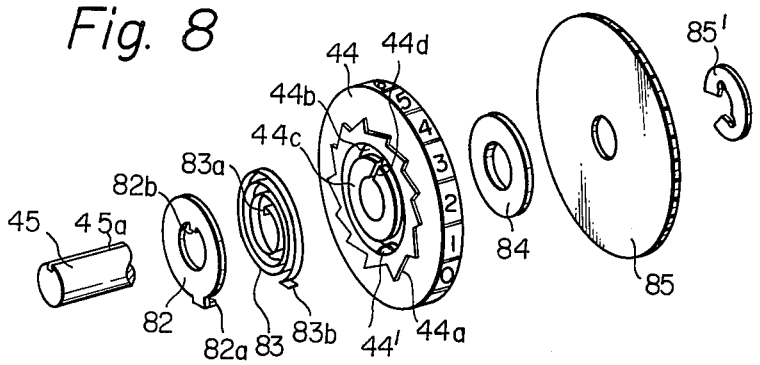
FIG. 8 is an exploded perspective view showing the construction of the printing rings and the elements cooperating therewith.

As shown in FIG. 8, a key way 45a is formed in the shaft 45 and stopper members 82 in the form of washers each belonging to the respective printing ring 44 are fitted on the shaft 45, and the stopper members 82 are rotated together with the shaft 45 by the engagement of lugs 82b formed in the members 82 with the key way 45a, while spring supporting portions 82a are formed in the respective members 82. The outer end of the spiral spring 83 received in the annular recessed portion 44b of each printing ring 44 is supported by the spring supporting portion 82a of each member 82 while the inner end of the spring 83 is fitted in the cut-out portion 44d so that the respective printing ring 44 is urged in the clockwise direction in FIG. 8 so that the respective ring 44 is resiliently arrested at the predetermined initial starting angular position with respect to the shaft 45 by the abutment of the portion 82a of the stopper member 82 against the projection 44'.

A pair of engaging discs 85 having knurled portions at the periphery thereof are positioned at the opposite ends of the assembly of the printing rings 44 with washers 84 interposed therebetween, and the discs 85 are prevented from being detached from the shaft 45 by means of split washers 85' fitted on the shaft 45 so that the discs 85 are rotated together with the shaft 45.

The discs 85 serve to rotate the ink roller 66' synchronously with the printing rings 44 when the ink roller 66' is abutted against printing rings 44 so as to prevent the relative shifting of the ink roller 66' with respect to the printing rings 44 for uniformly supplying ink to the latters as described later.

Thus, when the select levers 51 are actuated by the switching of the select magnets 55 caused by the control circuit upon issuance of the printing demand as the driving shaft 45 is rotating in the clockwise direction as shown in FIG. 8 so that the respective select levers 51 engage with the ratchet wheels 44*a* the respective printing rings 44 are selectively and temporarily arrested against the actions of the springs 83 while the driving shaft 45 is rotating so that the desired characters of the respective printing rings 44 are positioned at the printing position. After the printing operation, when the select levers 51 are released from the printing rings 44 by the actuation of the select release levers 56, 56', the printing rings 44 are rotated by the action of the springs 83 to return to the initial starting positions with respect to the driving shaft 45 at which the stopper members 82 are arrested by the projections 44' of the respective printing rings 44.

Figure 10:
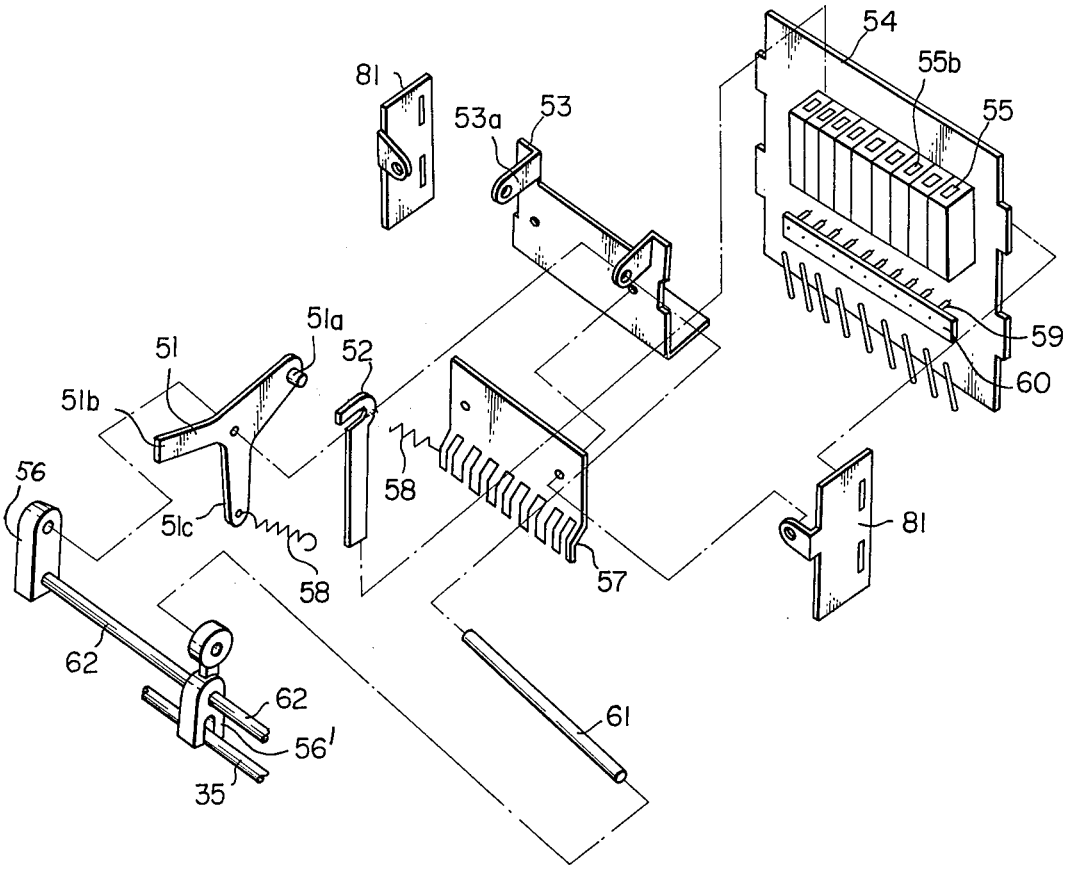
FIG. 10 is an exploded perspective view showing the arrangement of the select levers and the select magnets shown in FIG. 9.

Referring to FIGS. 9 and 10, the supporting plate 54 mounts thereon the select magnets 55 and a supporting plate 60 for mounting thereon diodes 59 for energizing the magnets 55, and the magnetic yoke 53 cooperating with the magnetic 55 is secured to the plate 54 by side plates 81. The shaft 61 is journaled by the brackets 53 of the yoke 53. The select levers 51 are swingably supported by the shaft 61. One end of each spring 58 is attached to the lower arm 51*c* of each select lever 51 while the other end of the spring 58 is attached to a comb-shaped mounting plate 57 attached to the yoke 53 so as to urge the respective select lever 51 in the counterclockwise direction thereby permitting the arresting claws 51*b* of the respective levers 51 to engage with the respective ratchet wheels 44*a*.

The pin 51*a* secured to each select lever 51 engages with the hooked portion of the armature 52 which is movably received in the hollow portion 55*b* of each magnet 55 and is adapted to be actuated by the energization and deenergization of the magnet 55. Thus, when the respective select magnets 55 are energized at the beginning of each printing cycle, the respective claws 51*b* are held apart from the ratchet wheels 44*a* against the action of the springs 58 until the respective magnets 55 are selectively deenergized by the control circuit of the printer for selection of the desired characters of the respective printing rings 44.

As previously described, the select release levers 56, 56' are fixedly secured to the shaft 61, and the shaft 62 is mounted at its respective ends on the levers 56, 56' so that the shaft 62 is positioned adjacent to the lower arms 51*c* of the levers 51, thereby permitting the respective levers 51 to be rotated in the clockwise direction (FIG. 9) by the engagement with the shaft 62 so as to be released from the printing rings 44 when the levers 56, 56' are rotated in the clockwise direction.

When the select release levers 56, 56' are rotated in the counterclockwise direction, the shaft 62 is moved apart from the lower arms 51*c* of the select levers 51 so as to permit the respective select levers 51 to arrest the respective printing rings 44*a*.

In order to reciprocally swing the select release lever 56', the lever 33 is provided (FIG. 11) which is swingably supported by a stationary shaft 33*a* secured to the printer frame and is urged in the counterclockwise direction by the spring 33*b* with its one end supported by the bent portion of the lever 33 while its other end is supported by a stationary portion of the printer frame. The pin 34 secured to the lever 33 is adapted to engage with the cam 32 secured to the cam shaft 70 and having the recessed cam portion 32*a* and the raised cam portion 32*b* by the action of the spring 33*b*, thereby reciprocally swing the lever 33 by the rotation of the cam shaft 70. The pin 35 secured to the lever 33 is slidably received in the bifurcated portions of the select release lever 56' so that the lever 56' is reciprocally swung when the lever 33 is reciprocally swung.

The angular phase of the cam portions 32*a*, 32*b* is so set that the recessed cam portion 32*a* engages with the pin 34 during the first half revolution of the cam shaft 70 so as to swing the lever 33 in the clockwise direction and, hence, to swing the select release lever 56' in the counterclockwise direction thereby moving the shaft 62 apart from the select levers 51 and permitting the select levers 51 to arrest the respective printing rings 44 upon deenergization of the magnets 55, while, during the last half revolution of the cam shaft 70 after the printing operation, the pin 34 engages with the raised cam portion 32*b* so that the select release lever 56' is swung in the clockwise direction so as to positively release the levers 51 from the ratchet wheels 44*a* by means of the shaft 62.

Referring again to FIG. 11, the slit disc 37 is secured to the shaft 45, and slits 37' are arranged circumferentially in the disc 37, the positions of the slits 37' respectively corresponding to the initial positions of the respective characters of the printing rings 44 with respect to the shaft 45 prior to the temporary arresting thereof by the select levers 51. The U-shaped detecting device 38 having the light source and the photoelectric element arranged to receive light from the light source straddles the disc 37 so that the light from the light source is passed through the slits 37' so as to be received by the photoelectric element for energizing the same to issue synchronizing pulses each time one of the slit 37' comes into the path of light from the light source as the disc 37 rotates. The synchronizing pulses are supplied to the control circuit of the printer so that selected characters of the printing rings 44 can be positioned at the printing position.

In operation, when the motor 1 is energized and the clutch magnet 74 is energized while the select magnets 55 are energized, the clutch mechanism is engaged to drive the shaft 45 and the cam shaft 70 while the select levers 51 are released from the ratchet wheels 44*a* allowing the rotation of the printing rings 44 as desired previously.

During the first revolution of the shaft 45, i.e., during the first half revolution of the cam shaft 70, the select magnets 55 are selectively deenergized by the control circuit by the aid of the synchronizing pulses from the detecting device 38 for selectively arresting the printing rings 44 by the select levers 51 so as to position the desired characters at the printing position.

As previously described, when the shaft 45 rotates a first revolution and the cam shaft 70 rotates a first half revolution, the roller pad supporting frame 24 is swung by the actuation of the linkage means 22, 23, 22', 23' so as to press the roller pad 25 against the printing rings 44 at the printing position thereby printing the selected characters of the printing rings 44 on the paper held therebetween. When the frame 24 is returned to its initial position during the second one revolution of the shaft 45, i.e., during the laft half revolution of the cam shaft 70, the paper feeding is effected by the one-way clutch spring 90 cooperating with the lever 26 as previously described.

On the other hand, when the second revolution of the shaft 45 is commenced, i.e., when the last half revolution of the cam shaft 70 is commenced, the pin 34 of the lever 33 is actuated by the raised cam portion 32*b* of the cam 32 so that the select levers 51 are positively held disengaged from the printing rings 44 by the shaft 62 of the select release levers 56, 56' to allow the printing rings 44 to return to the initial starting positions with respect to the shaft 45 by the action of the springs 83.

At the end of the two revolution of the shaft 45, i.e., at the end of one revolution of the cam shaft 70, the clutch mechanism is disengaged to terminate one printing cycle.

Ink roller mechanism

Figure 15:
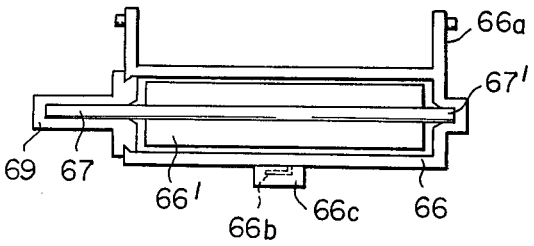
FIG. 15 is a sectional view showing the ink roller device incorporated in the printer of FIG. 1.

Referring to FIGS. 1, 9 and 15 – 17, the ink roller holder body 66 is swingably arranged beneath the printing rings 44 by the arms 16*a* and the body 66 is urged toward the printing rings 44 by the action of the spring 64 as described previously. The ink roller 66' is rotatably supported in the body 66 with one end 67' of the shaft 67 secured to the ink roller 66' rotatably fitting in the recess formed in the closed end of the body 66, while the other end of the shaft 67 is rotatably fitted in the hole formed in the cover 69 detachably mounted on the body 66. As shown in FIG. 15, the cover 69 is snugly attached to the body 66 by the inwardly projecting annular projection formed in the opened end of the body 66 and the annular groove formed in the cover 69.

By the action of the spring 64, the ink roller 66' is adapted to abut against the printing rings 44 through the cut-out portion 66*e* formed in the body 66 so as to supply ink to the printing rings 44. The projection 66*c* formed on the outer surface of the body 66 cooperates with the cam 68 secured to the cam shaft 70 as described earlier. The configuration of the cam 68 is so determined that the ink roller 66' is held apart from the printing rollers 44 during the first half revolution of the cam shaft 70, i.e., during the first revolution of the shaft 45 within which the selection of the characters and the printing operation have been effected, while, during the last half revolution of the cam shaft 70 in which the arresting of the printing rings 44 has been effected so as to return to their initial starting positions with respect to the shaft 45 and to rotate one revolution together with the shaft 45, the body 66 is swung toward the printing rings 44 to abut the ink roller 66' against the printing rings 44 by the action of the spring 64 so that ink is uniformly applied to the respective characters on each printing rings 44.

In order to insure uniform application of ink to the printing rings 44 from the ink roller 66', the engaging discs 85 of the printing ring assembly is adapted to contact with the ink roller 66' when the latter is urged against the printing rings 44 so that the ink roller 66' is rotated synchronously with the printing rings thereby preventing relative slip therebetween to insure positive and uniform application of ink to the printing rings 44.

Figure 17:
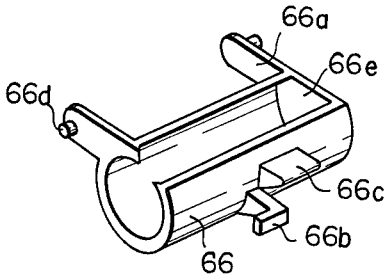
FIG. 17 is an exploded perspective view showing the construction of the ink roller device of FIG. 15.
Figure 16:
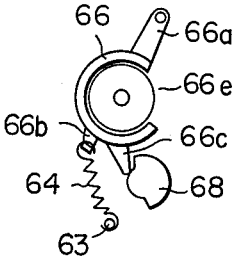
FIG. 16 is a side view of FIG. 15.
Figure 16:
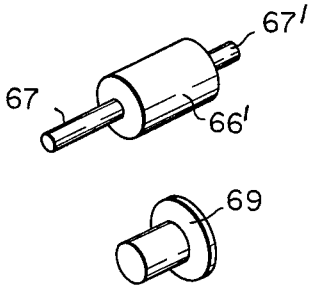

As shown in FIGS. 15 and 17, the other end of the shaft 67 of the ink roller 66' is sufficiently longer than the one end 67' so that the operator can easily manipulate the ink roller 66' without contaminating the operator's hand by grasping the larger end of the shaft 67 for interchanging the ink roller 66'. The recess of the body 66 for receiving the end 67' of the shaft 67 and the hole of the cover 69 for receiving the shaft 67 are chamfered or rounded off at the edges thereof facilitating the insertion of the shaft 67.

Since the ink roller 66' can be interchanged by removing the ink roller 66' along the longitudinal axis thereof, the space in the printer for arranging the ink roller 66' can be made to the minimum.

The comb-shaped lever 42*a* for preventing undesired printing on the paper other than the selected characters has the boss 42 which is pivoted by the stationary shaft 42*b* secured to the printer frame. The lever 42*a* is urged apart from the printing rings 44 by the action of the spring 42*c* connecting the lever 42*a* to the stationary point in the printer. The rotation of the lever 42*a* by the spring 42*c* is limited to an appropriate position by the stopper 43.

Figure 18:
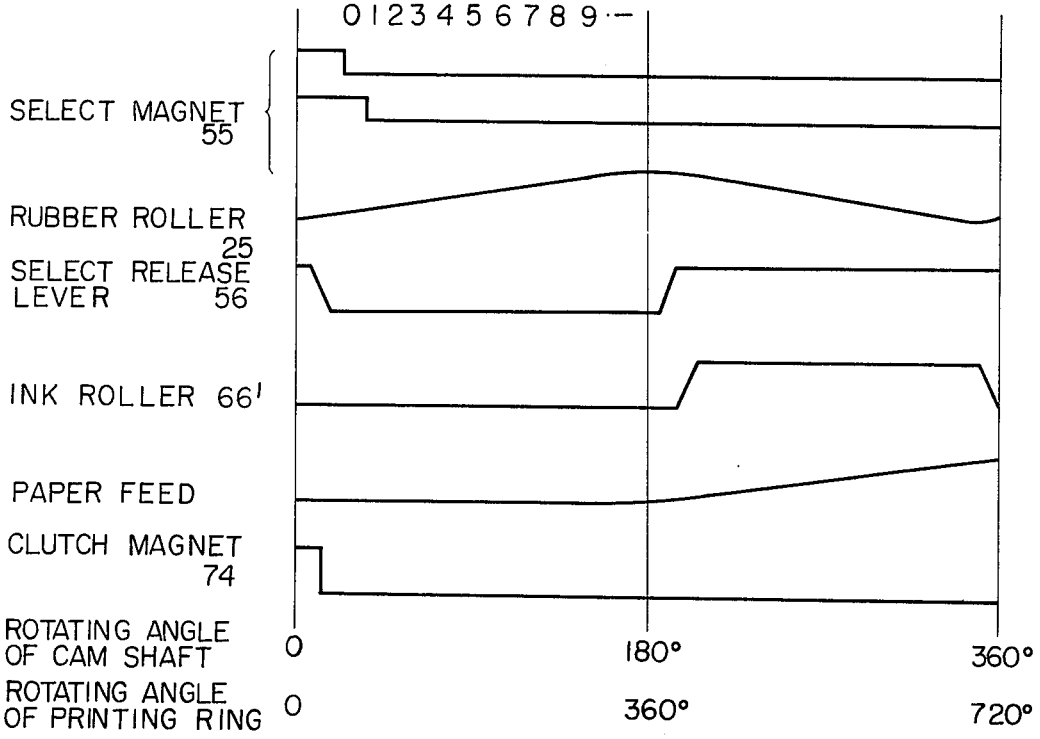
FIG. 18 is a time chart showing the sequence of operations of various elements of the printer of the present invention.

FIG. 18 shows the time sequence of operations of the variout components of the printer which will be readily understood by the previous description.

Figure 19:
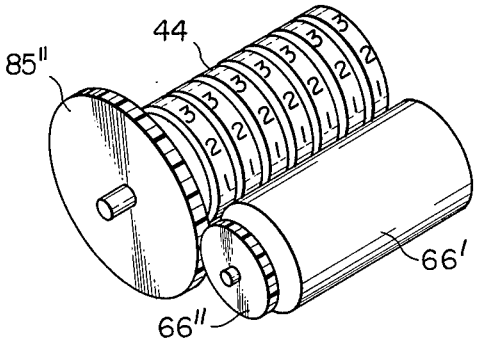
FIG. 19 is a perspective view showing a modification of the engaging means for synchronizing the rotation of the ink roller with those of the printing rings for uniformly supplying ink to the latters.

FIG. 19 shows a modification of the engaging means for synchronizing the rotation of the ink roller 66' with the printing rollers 44. In FIG. 19, the gear 85'' is secured to the shaft 45 instead of the discs 85 in FIG. 8 while the gear 66'' is secured to the ink roller shaft 26*a* which engages with the gear 85'' when the ink roller 66' is abutted against the printing rings 44 for supplying ink thereto. Thus, the ink roller 66' is rotated in synchronism with the printing rings 44 to insure uniform supply of ink to the respective characters on each printing ring 44.

Since the printer of the present invention utilizes one single cam shaft 70 coupled with the printing ring driving shaft 45 and rotated in one and the same direction in each printing cycle and the timing of operations of various components of the printer is obtained by the cam shaft 70, a high accuracy of operation of the printer is insured while the printer can be made compact and simple.

In the above description, the ink roller is used in supplying ink to the printing rings.

However, it is apparent that ink ribbons may be used in place of the ink roller in the conventional manner.

In the present invention, one printing cycle may be completed by rotating the printing rings by one revolution instead of two revolutions. In this case, the selection of characters is effected within the first half cycle of each printing cycle and the printing operation is effected at the end of the first half cycle, while the returning of the printing rings to their initial starting positions and the paper feeding are effected within the last half cycle of each printing cycle.

Further, in the present invention, the returning of the printing rings to their initial starting positions and the paper feeding may also be effected within the first half cycle of each printing cycle while the selection of characters and the printing operation are effected within the last half cycle of each printing cycle.

Figure 20:
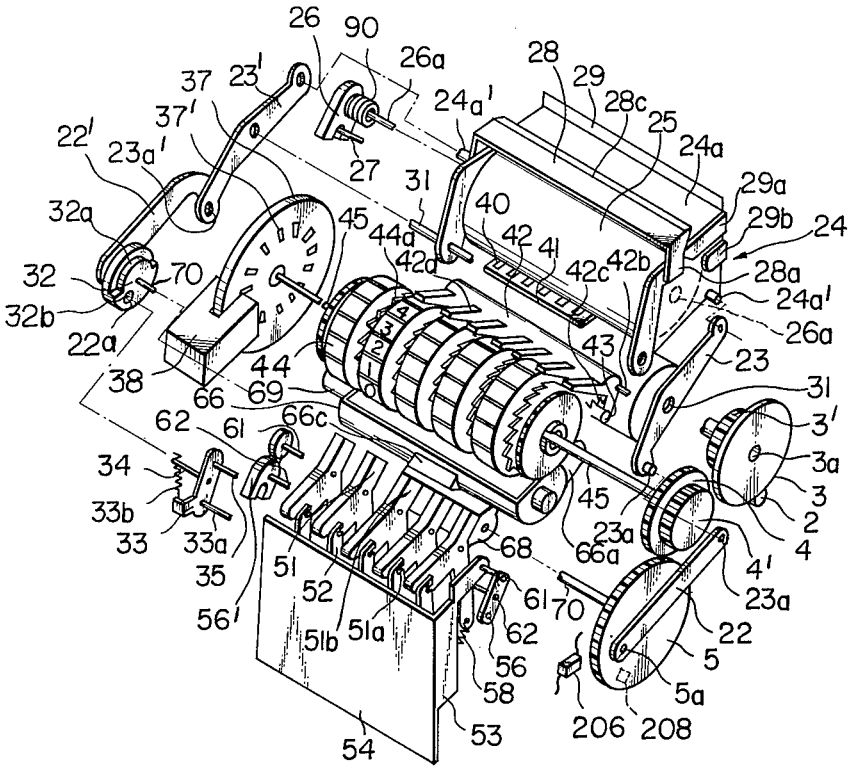
FIG. 20 is an exploded perspective view showing a second embodiment of the printer of the present invention.

FIG. 20 shows a second embodiment of the printer of the present invention. The printer shown in FIG. 20 is substantially similar in construction and in operation to that shown in FIG. 1 except that the clutch mechanism of FIG. 1 is omitted and, instead, the reduction wheel 3 is positioned to contact with the motor pulley 2 at all times so that the reduction gear 3 and, hence, the driving shaft 45 as well as the cam shaft 70 are driven each time the motor 1 is energized during each printing cycle. In order to automatically terminate the deenergization of the motor 1 and the driving of the shaft 45 and the cam shaft 70 at the end of each printing cycle, a magnetic piece 208 is mounted on the gear 5 while a non-contact switch 206 such as a reed switch is positioned adjacent to the gear 5 so as to cooperate with the magnetic piece 208 thereby issuing a signal each time it is actuated by the magnetic piece 208 each time the gear 5 rotates a revolution.

The position of the magnetic piece 208 with respect to the gear 5 is so determined that the switch 206 is actuated by the magnetic piece 208 at the end of two revolutions of the shaft 45, i.e., at the end of one revolution of the cam shaft 70 at which time one printing cycle is terminated. The signal from the switch 206 is applied to the control circuit of the printer so that the motor 1 is automatically deenergized at the end of each printing cycle. Since no complicated clutch mechanism is incorporated in the embodiment of FIG. 20, it is made extremely simple in construction and very inexpensive in manufacture while it affords very accurate and reliable function and insures extremely accurate timing relationship between the operations of various components of the printer.

I claim:

1. A line printer having a plurality of rotatable printing rings (44) coaxially arranged adjacent each other and carrying on at least more than one-half of each of their peripheral surfaces a plurality of characters spaced in the circumferential direction of said rings, the printer comprising means (45) for rotating said rings, resilient means interposed between said rotating means and each of said rings, means providing a starting position so that one cycle of a printing operation is effected by two revolutions of said rotating means from said starting position, arresting means (51) for selectively engaging said rings independently from each other while said rotating means is operated so as to temporarily arrest the rotation of said rings thereby shifting the relative position of the respective ring with respect to said rotating means from a predetermined relative position thereof for simultaneously holding each selected character at a printing position, a movable roller pad (25) abutting against said rings at a predetermined printing position with respect to said rings, thereby permitting one of said characters to be positioned by the arresting means at the printing position and be printed simultaneously on a paper held between said roller pad and said rings so as to form a printed line on the paper, means (15, 22 to 24, 22', 23', 32) for moving said roller pad toward and away from said rings to permit said roller pad to abut against said rings, means (25,26,40,90) for feeding the paper after each printed line, the operation of the printer being controlled so that the printed line is formed on the paper after selection of said characters has been completed, and the paper is fed after the printed line has been formed while said rings are released from their selectively arrested positions so as to restore the same to said predetermined relative position with respect to said rotating means and to terminate one printing cycle, wherein said rings are rotated by said rotating means in the same direction within each printing cycle, further comprising a stopper member (82) constituted as a washer for each respective ring, each stopper member having inner and outer projections, one of said projections being engaged with said rotating means so that said stopper member is rotatable with said rotating means, said resilient means comprising a coil spring having inner and outer ends, one of said ends of the coil spring being secured to a respective said printing ring, the other end of said coil spring being engaged by the other of said projections of the associated stopper member, said means for providing a starting position comprising an arresting projection on said printing ring engagable by said other end of the coil spring thereby permitting the respective ring to be held at said predetermined relative position by said arresting means while the rotating means continues to rotate and compress said coil spring whereas when said respective ring is free from said arresting means said ring undergoes rotation together with said rotating means, said printing ring after release by said arresting means after a printing operation rotation by the action of the compressed spring until the ring returns to said starting position, and mechanical means (3', 4, 4', 5, 70) for intercoupling said rotating means, said moving means and said feeding means in a predetermined time relation between the operations of said arresting means, said moving means and said feeding means being so set that the selection of said characters and the arresting of said rings as well as the printing operation are effected within the first revolution of said rotating means, while paper feeding and releasing of said rings are effected within the last half of each printing cycle so as to restore the printer to said starting position.

2. The line printer as defined in claim 1, further comprising an ink roller (66') movably arranged adjacent said rings (44) and means (66c, 68) for actuating said ink roller, said actuating means being coupled to said rotating means (45) so that said ink roller is so actuated in timed relation to said rings that said ink roller is held away from said rings during the first revoltion of said rotating means while said ink roller is pressed against said rings during the second revolution of said rotating means to supply ink.

3. The line printer as defined in claim 1, further comprising a driving motor (1) a single common shaft (3) and clutch means (6,8,12,80) for releasably coupling said motor with said shaft during each printing cycle, said shaft being part of said mechanical means (3', 4, 4', 5, 70) so that the driving of said rings (44), of said roller pad (25) and of said feeding means (25, 26, 40, 90), and the releasing of the arresting of said rings after the selection of said characters are effected through said shaft, thereby ensuring the predetermined timing relation between the operations of said rings, said roller pad and said feeding means.

4. The line printer as defined in claim 1, further comprising a driving motor (1) driven at the beginning of each printing cycle and stopped at the termination of each printing cycle, a single common shaft (3) directly driven by said motor, said shaft being part of said mechanical means (3', 4, 4', 5, 70) so that the driving of said rings (44), of said roller pad (25) and of said feeding means (25, 26, 40, 90), and the releasing of the arresting of said rings after the selection of said characters are effected through said shaft, thereby ensuring the predetermined timing relation between the operations of said rings, said roller pad and said feeding means.

5. The line printer as defined in claim 1, further comprising a driving motor (1) driven at the beginning of each printing cycle, a single common shaft (3) directly driven by said motor, and detecting signal generating means (206, 208) for generating a detecting signal at the termination of each printing cycle, said shaft being part of said mechanical means (3', 4, 4', 5, 70), while said signal generating means is connected so that the driving of said motor is stopped by said signal generating means at the termination of each printing cycle.

6. The line printer as defined in claim 1, further comprising a driving motor (1) driven at the beginning of each printing cycle, a single common shaft (3) directly driven by said motor, said shaft being part of said mechanical means (3', 4, 4', 5, 70), thereby ensuring the predetermined timing relation between the operations of said rings (44) of said roller pad (25) and of said feeding means (25, 26, 40, 90).

7. The line printer as defined in claim 1, further comprising an ink roller (66') movably arranged adjacent said rings (44) and means (6c, 68) for actuating said ink roller, said actuating means being coupled with said mechanical means (70) so that said ink roller is pressed against said rings by said actuating means during the rotation of said rings after the same have been released from their temporarily arrested positions, thereby permitting said rings to be supplied with ink onto said characters from said ink roller.

8. The line printer as defined in claim 7, further comprising a driving motor (1), a single common shaft (3) and clutch means (6, 8, 12, 80) for releasably coupling said motor with said shaft during each printing cycle, said shaft being part of said mechanical means (3', 4, 4', 5, 70) so that the driving of said rings (44) of said roller pad (25), of said feeding means (25, 26, 40, 90) and of said ink roller (66'), and the releasing of the arresting of said rings after the selection of said characters are effected through said shaft, thereby ensuring the predetermined timing relation between the operations of said rings, said roller pad, said feeding means and said ink roller.

9. The line printer as defined in claim 7, further comprising a driving motor driven at the beginning of each printing cycle and stopped at the termination of each printing cycle, a single common shaft (3) directly driven by said motor, said shaft being part of said mechanical means (3', 4, 4', 5, 70) so that the driving of said rings (44) of said roller pad (25), of said feeding means (25, 26, 40, 90) and of said ink roller (66'), and the releasing of the arresting of said rings after the selection of said characters are effected through said shaft, thereby ensuring the predetermined timing relation between the operations of said rings, said roller pad, said feeding means and said ink roller.

* * * * *